US005567045A

United States Patent [19]

Bucek

[11] Patent Number: 5,567,045

[45] Date of Patent: Oct. 22, 1996

[54] DECORATIVE LIGHT FIXTURE COVERS FOR OUTDOOR AND INDOOR LIGHTS

[76] Inventor: James R. Bucek, 5700 Freschcorn Rd., Cranberry Township, Butler County, Pa. 16066

[21] Appl. No.: 598,700

[22] Filed: Feb. 8, 1996

[51] Int. Cl.[6] ..... F21S 1/10

[52] U.S. Cl. ..... 362/363; 362/368; 362/431; 362/806; D26/128

[58] Field of Search ..... 362/806–809, 362/363, 368, 431; D26/118, 119, 128

[56] References Cited

U.S. PATENT DOCUMENTS

| | | | |
|---|---|---|---|
| 2,749,432 | 6/1956 | Dorsey . | |
| 2,815,439 | 12/1957 | Plubell . | |
| 2,849,601 | 8/1958 | Walzer . | |
| 3,101,907 | 8/1963 | O'Reilly . | |
| 4,847,741 | 7/1989 | Boettinger | 362/368 |
| 5,178,454 | 1/1993 | Lai . | |
| 5,226,721 | 7/1993 | Stokes . | |
| 5,359,506 | 10/1994 | Koleno . | |

*Primary Examiner*—Carroll B. Dority
*Attorney, Agent, or Firm*—John E. Curley; Nora C. Peace

[57] ABSTRACT

A decorative light fixture cover is disclosed which is adapted to enclose existing shaded inground lights, lampposts and carriage lamps. The covers are constructed of hinged sections which open to permit them to be placed over and around the existing shaded light. When closed, the hinged sections form a collar around the light source mounting post.

Means are also provided to secure the collar firmly to the mounting. Also disclosed is a means to lock the decorative shade to the post after installation.

21 Claims, 6 Drawing Sheets

DECORATIVE LIGHT FIXTURE COVERS FOR OUTDOOR AND INDOOR LIGHTS

The present invention relates to decorative covers for lights. More particularly, the present invention relates to decorative covers for lights with installed shades which cover the light bulb or source. Still more particularly, the present invention relates to seasonal and holiday type decorative covers for use on installed inground garden or walkway lights and lamp posts which can be installed over the existing covers or shades already in place on such lights without the necessity of removing them.

BACKGROUND OF THE INVENTION

Decorative light fixtures have been used in the past. They have been in the form of decorative light bulbs and also as covers for ordinary light bulbs.

U.S. Pat. No. 5,226,721 shows an assembly for use as a garden light that provides a decorative light, fixed in place on a post, and which creates an ascetically pleasing atmosphere conducive to picnics or cook-outs. Essentially, a light assembly as shown therein may be used as the light source for applicant's device as will be evident from the ensuing description of the invention.

U.S. Pat. No. 2,849,601 shows a system for applying decorative covers to a light source which applies covers to a base assembly which holds a light bulb and wiring for a power source. The decorative cover is then attached to the light bulb housing with screws.

U.S. Pat. No. 2,815,439 shows a similar arrangement of a plurality of shades placed over a multiple set of light bulbs attached to a cover on an Easter basket.

A more recent patent along the same lines is U.S. Pat. No. 5,359,506, again showing a plurality of decorative ornaments or shades over a set of light bulbs on a light string. The ornaments are screwed onto the outer surface of the light bulb socket which is provided with appropriate threading to mate with the internal threads provided on the inside surface of the ornaments.

All of these devices are concerned with either a light which, when assembled as a garden light, is aesthetically pleasing or light bulbs which have decorative covers placed over them.

Applicant's invention is directed to light systems such as inground walkway, driveway and garden lighting as well as lamppost lights on driveways and carriage lights mounted on walls and doorways of residential and commercial buildings. These systems like that of U.S. Pat. No. 5,226,721 are self-contained. All the light bulbs are in place in the lighting and enclosed with appropriate covers and/or shades. To apply decorative covering to such lights requires removing the existing covers and/or shades from the light source and applying the new decorative cover over the lights and securing it thereon. The removed covers and shades will then have to be stored until the decorative cover is no longer needed for its intended use and again more disassembly and assembly steps are required. In the case of the replacement of a set of driveway lights for example to place covers over the bulbs in lieu of the existing shades, a time consuming job is required, since the multiple light sources will require decorative covers to be placed over each.

In instances where a unitary decorative cover is provided for inground lighting, the bottom opening is typically sized to fit over the light bulb and thus mounting the cover requires affixing it to the light bulb housing directly or with an appropriate adapter for the light housing. An example of this latter arrangement is the Malibu® Halloween Pumpkin sold by Intermatic, Inc., Spring Grove, Ill. for use on their Malibu® low voltage light fixtures having risers or inground stakes. The pumpkin is sized so it can be placed over the light bulb after the normal shade or cover on the light bulb is removed. An adapter for use in serving as a seat for the pumpkin bottom is fitted to the light socket housing and is supplied with the pumpkin by the manufacturer.

While all of these prior art devices have utility, they do require time consuming assembly and disassembly for installation and costly mechanical and electrical parts to insure proper installation of the decorative cover or covers. In addition, the parts of the original light covers and shades removed to place the decorative covers on the light source must be carefully stored so that the original covers can be replaced when the holiday or seasonal events depicted by the decorative covers no longer exist.

SUMMARY OF THE INVENTION

Applicant's invention provides a system which allows for the rapid installation of decorative covers for covered light sources without the need for any disassembly of existing shading of those light sources. The covers can be applied quickly and safely over the existing covers and the decorative covers can be firmly attached to the support for the light source. Changes in the decorative covers can be made to suit a season or holiday with a minimum of time and effort on the part of the property owner since no need to remove the conventional covering on the light sources to be decorated is required. Further, no storage of the existing covers is required and the possible loss of any parts removed under replacement systems such as typified by the above discussed prior art is avoided.

Applicant's invention provides a decorative cover system for all occasion lighting by using covers which can be placed over an already installed and covered light source. This is accomplished by providing a cover member which is sectioned in at least two parts and is provided with means to enclose a light source when the decorative cover parts are joined together around the light source. The cover parts, when joined, are mounted around the light source and the post or stake on which the light is mounted. The preferred embodiment of the invention uses plastic molded covers which have been molded with the appropriate decorative designs and are provided with means depending from them which are adapted to envelop the mounting posts used to support the covered light source being decorated so that the decorative cover can be rigidly affixed to it. In using plastic molded parts, the decorative cover may be split, for example, into two parts and hinged at the top and provided on the bottom of each half with downwardly projecting plastic half-sleeves or collars, which when the hinged halves of the cover are brought together around the base of the light source depend downwardly around the support for the covered light source, forming a sleeve that can be adjusted in diameter to snugly grip the support. In the preferred mode means are also provided on the half-sleeves or collars to ensure that the sleeve can be tightened with sufficient force to lock the decorative cover over the covered light source and its support post to thereby prevent it from slipping during use.

For a more complete understanding of the invention and the many variations that may be utilized to provide the unique and particular features and advantages it provides reference is now made to the accompanying drawings and description.

DETAILED DESCRIPTION OF THE DRAWINGS

Figure 1:
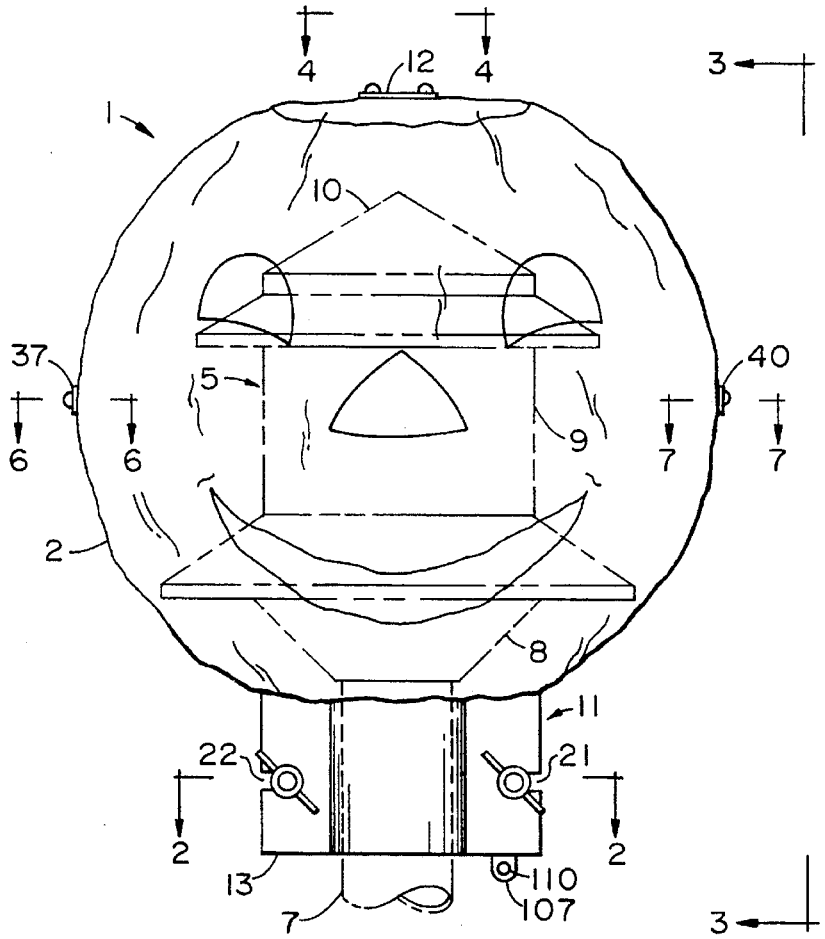
FIG. 1 is a front elevation of one preferred embodiment of a decorative cover of the instant invention.
Figure 2:
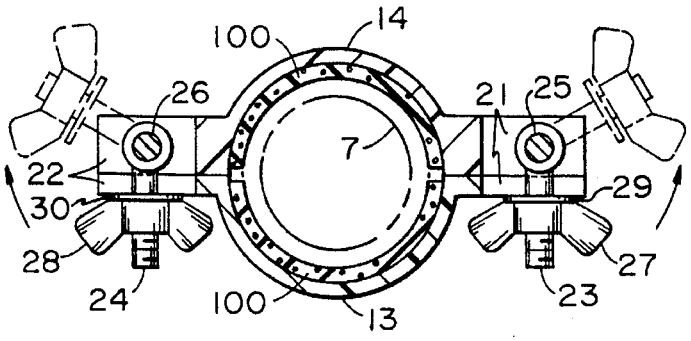
FIG. 2 is an enlarged cross sectional view taken on line 2—2 of the clamping means of FIG. 1.
Figures 3, 3A:
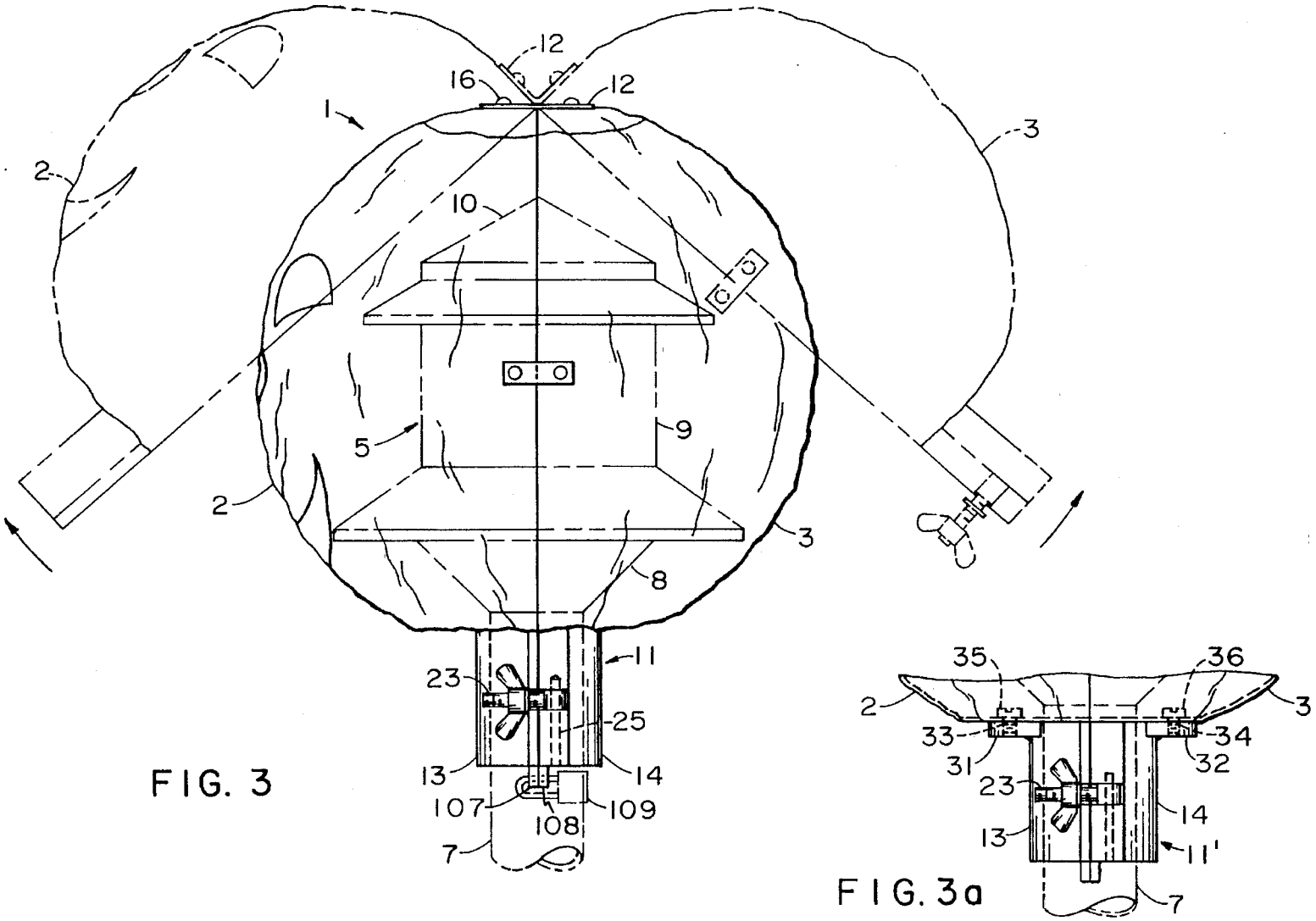
FIG. 3 is a side elevation view of the preferred embodiment taken on Line 3—3 of FIG. 1, and showing the open position of decorative cover of the invention.
FIG. 3*a* is a side elevation of another embodiment of the invention to show an alternate means of applying a sleeve to the cover bottom.

Turning to the drawings and in particular to FIGS. 1, 2, and 3, there is shown a decorative cover member generally indicated as 1, which, as shown, is divided into two sections 2 and 3, (see FIG. 3) one section 2 has depicted on the surface thereof a face, and the second section 3 shows a plain surface. In the embodiment shown the shape and face 3 of the decorative cover member 1 resemble a pumpkin. Cover 1 as shown, encompasses entirely a light fixture 5, which is supported on a post 7 at its base 8. This light fixture 5 has a light diffuser shade 9 over which a cover 10 rests. The half-sections 2 and 3 of the cover 1 are connected to each other by a hinge 12. As shown, hinge 12 is a flexible flat plate creased in the middle to permit it to be freely flexed. It is secured to the two cover sections 2 and 3 by two sets of snap pins 16 and 17 affixed to the cover sections 2 and 3 respectively through a corresponding set of apertures 18 and 19 located on cover sections 2 and 3 respectively. These pins 16 and 17 and apertures 18 and 19 are shown more clearly in FIGS. 4 and 5. As shown therein, the pins 16 and 17 penetrate the cover sections 2 and 3 and hold the hinge 12 in place against the inside surface of cover sections 2 and 3 once the tip of the pins 16 and 17 pass through the cover sections and spread out to form a flat engaging surface therewith.

The decorative cover member 1 is provided, when in assembled condition as shown by FIG. 1, with a sleeve member 11 which is constructed and arranged to encompass post 7 which supports a light fixture 5 and can be adjusted in diameter to provide a secure tight mounting of the decorative cover 1 onto the post 7. Sleeve 11 is formed by joining half-sections 2 and 3. Half-section 2 has depending downwardly from its lower end a half-sleeve 13. Similarly, half-section 3 has depending downwardly from its lower end, a half-sleeve 14. Both half-sleeves 13 and 14 are arcuate in shape and constructed to fit around post 7 when half-covers 2 and 3 are closed around post 7. Half-sleeve 14 is provided with slots 21 and 22 on the outside of each side thereof, which run through the side in a direction transverse to the vertical axis of post 7. Half-sleeve 13 is supplied with slots 21 and 22 on the outside of each of its sides. Swing eye bolts 23 and 24 are positioned in slots 21 and 22 respectively by pivot pins 25 and 26 mounted in the walls of slots 21 and 22 in half-sleeve 14. These pins 25 may be spring dowels or straight press fit dowels. Typical eye bolts, such as 23 and 24 are manufactured by Reid Tool Supply, Muskegon, Wis. The swing eye bolts 23 and 24 are provided with wing nuts 27 and 28 and washers 29 and 30 respectively. They are moved in the slots of half-sleeves 13 and 14 freely and secure them to post 7. If necessary or required, for a tighter fit of sleeve sections 13 and 14, around post 7, a split ring gasket 29 may be provided on the inside surfaces of sleeve sections 13 and 14 to provide a more secure fit against post 7 when wing nuts 27 and 28 are tightened against bolts 23 and 24 and the diameter of resulting sleeve 11 is compressed and engages the post 7 to secure cover 1 in place around the light fixture 5 and above post 7.

While decorative cover 1 and integral sleeve sections 13 and 14 are preferred, alternate means for providing sleeve sections 13 and 14 are encompassed by the instant invention. Thus, as seen in FIG. 3*a*, the cover 1 is secured to the post 7 by two half-sleeves 13 and 14. Each half-sleeve is provided with integral flanges 31 and 32 having threaded holes 33 and 34 therein. Mounting screws 35 and 36 are turned into threaded holes 33 and 34 to secure the half-sleeves 13 and 14 to the post 7, forming sleeve 11'. Sleeve 11' has the same configuration as herein above described in the discussion dealing with FIGS. 1, 2, and 3. It functions in the same way with appropriate slots, swing eye bolts, and pivot pins. The only distinction between the embodiments is that in FIG. 3*a* the sleeves are separate and distinct pieces from the cover member and are mechanically attached to the cover sections by the threaded screws and mating threaded holes in the mounting flanges on the upper ends of the half-sleeves. Obviously, other mechanical methods of attaching half-sleeves 13 and 14 to the cover sections can be employed, such as snap pins of adequate length to engage and hold the sleeves against the bottom to the cover sections, bolt and nut arrangements to accomplish the same, and the like.

Figure 4:
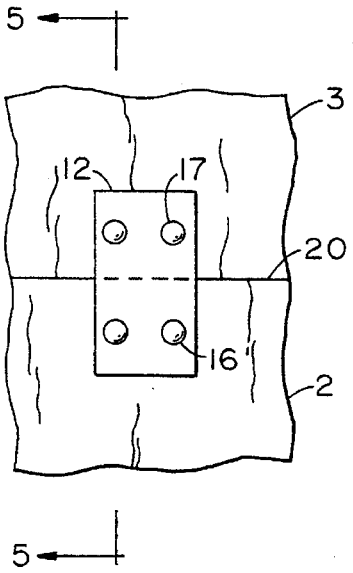
FIG. 4 is an enlarged top view of a hinge on the cover of FIG. 1 taken on Line 4—4.
Figure 5:
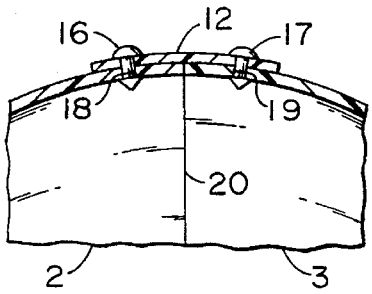
FIG. 5 is a cross-section through the hinge of FIG. 4 taken on Line 5—5, showing the mounting of the hinge to the cover with appropriate snap-lock pins.

Turning to FIGS. 4 and 5, the hinge 12 is shown in an enlarged top view as a contoured, flexible plate having on either side of the center line 20 of cover 1, apertures 18 and 19. The apertures 18 and 19 have snap pins 16 and 17 inserted through them to lock the hinge 12 firmly to both sides 2 and 3 of cover 1.

Figure 6:
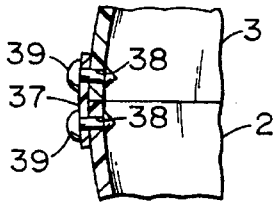
FIG. 6 is a cross-section of the optional snap-lock pin clip of FIG. 1 taken on Line 6—6.
Figure 7:
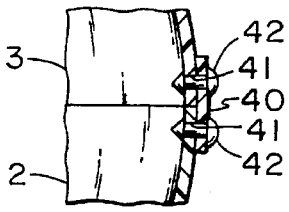
FIG. 7 is a cross-section of optional snap-lock pin clip of FIG. 1 taken on Line 7—7.

FIGS. 1, 3 and in particular, FIGS. 6 and 7 show the use of side clips 37 and 40 which are generally contoured to the shape of the cover's sides. Clip 37 is provided with apertures 38 which have snap pins 39 inserted through them and engaging sides 2 and 3 of cover 1. Similarly clip 40 is provided with apertures 41 through which snap pins 42 pass and engage sides 2 and 3 of cover 1.

Figure 8:
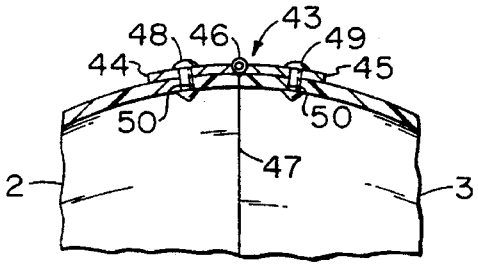
FIG. 8 is a cross-sectional view of an alternate means of pivoting the two halves of the decorative cover using a conventional hinge.

FIG. 8 shows a conventional hinge 43 having conventional interlocked plates 44 and 45 joined together by hinge pin 46 at its center line 47. Hinge 43 is attached to sides 2 and 3 of cover 1 with a set of snap pins 48 and 49 inserted through holes 50 in the half-covers 2 and 3 to hold the hinge 43 firmly to these parts of cover 1.

Figure 9:
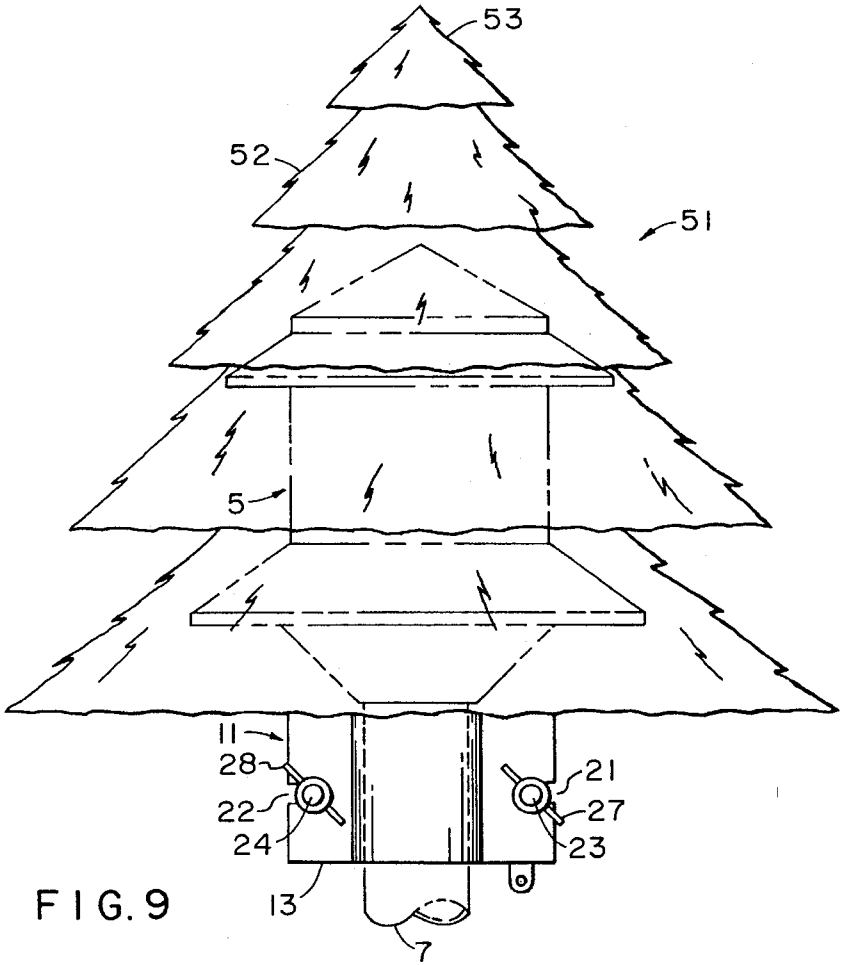
FIG. 9 shows a front elevation of a seasonal decorative cover in the shape of a tree, and showing in phantom, the existing light it encloses.

FIG. 9 shows an example of another decorative cover in which a Christmas tree 51 is shown attached to post 7 using the same type of sleeve 11 and fasteners as described above in reference to FIGS. 1, 2 and 3. Shown in this figure, as well as in FIGS. 1 and 2 in phantom, is the outline of the shaded garden light 5 which the decorative tree encloses. In this FIG. 9, the hinge used to connect the sides forming the tree is not shown since it is located beneath the top 53 of tree 51 on the surface of the underlying branch 52 which has a flat surface to accommodate a hinge. The top member 53 is placed on top of branch 52 after the sides of the tree 51 are brought together to form the sleeve 11 and fasteners shown and numbered as they appear in FIGS. 1, 2 and 3.

Figure 10:
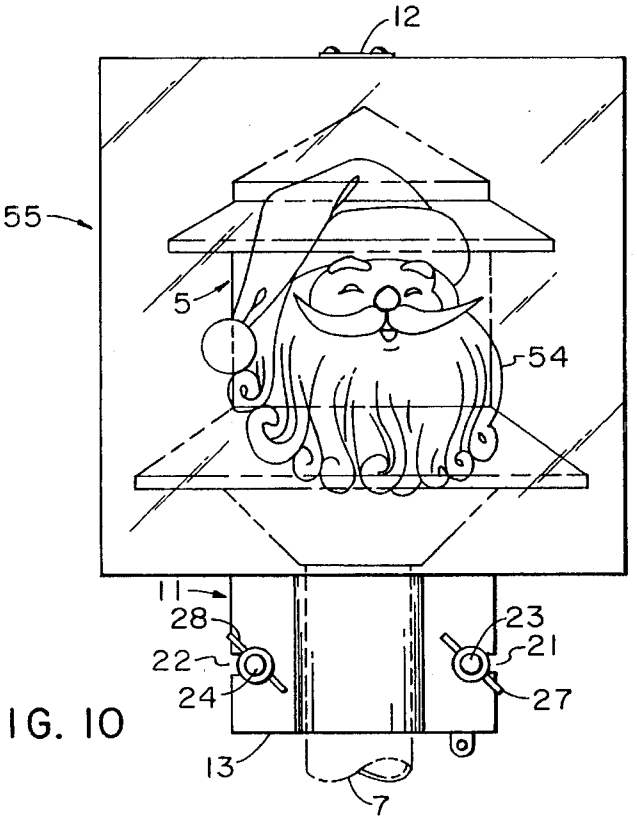
FIG. 10 shows a front elevation of a decorative cover, square in shape, on which is a decorative design, and showing in phantom, the existing light it encloses.

FIG. 10 shows a further embodiment of decorative cover that can be used. In this application the cover 1 is generally square on all sides and forms a cube 55. The cube 55 is typically comprised of half covers which join below post 7 forming a sleeve 11 with fasteners that may be constructed as shown identical to those used in FIGS. 1, 2 and 3. For convenience, the same numbers are used to designate the parts of these fasteners as were used in FIGS. 1, 2 and 3 above. In this embodiment the cube 55 is shown as being translucent with a decorative design 54 being painted or affixed to the surface of the cube 55. While only one side of cube 55 is visible, the decorative design 54 or a combination of other seasonal characters can be placed on the other sides, (not shown) if desired. Once again, the cube 55 covers the garden light 5 completely and as can be seen does not interfere in any way with the conventional shading used by that light.

Figure 11:
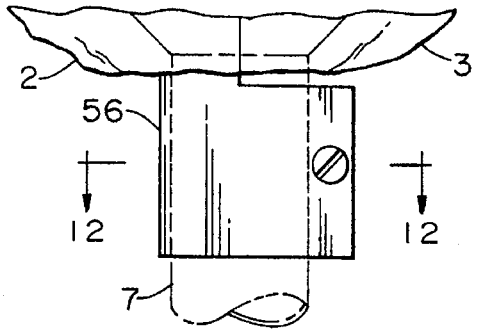
FIG. 11 is a partial side elevation of the base of a decorative cover such as FIG. 1, with an alternate clamping means for mounting a decorative cover to a post.
Figure 12:
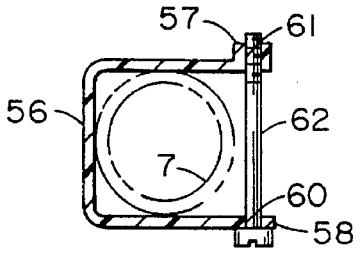
FIG. 12 is a cross-section of the clamp of FIG. 11 taken on Line 12—12.

FIGS. 11 and 12 show an embodiment of the invention which utilizes an alternate clamping system to secure the decorative cover 1 to the light post 7. As shown, a downwardly depending collar 56 is provided integral with a side 2 of cover 1 and is sufficiently wide so that upon closure of the sides of cover 1 it encircles post 7 forming a u-clamp around it. The opposite ends 57 and 58 of the u-clamp formed by collar 56 have a bolt 62 pass in through side 58 and inserted into threaded hole 61 in side 57. Threading the bolt 62 in hole 61 brings the ends 57 and 58 together to firmly affix decorative cover 1 above post 7 and around the light 5.

Figure 13:
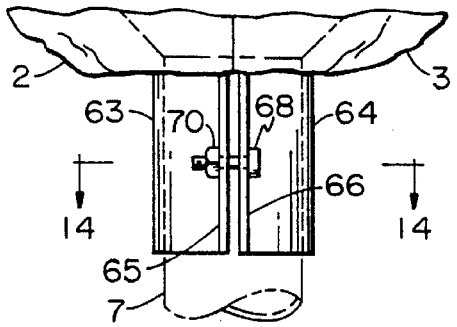
FIG. 13 is a partial side elevation of the base of a decorative cover such as FIG. 1, showing a further clamping embodiment for mounting a decorative cover to a post.
Figure 14:
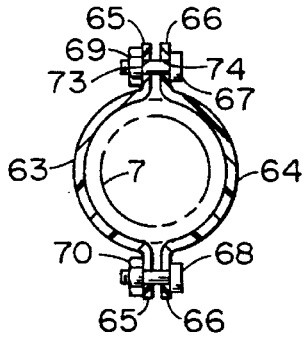
FIG. 14 is a cross-section of FIG. 13 taken on Line 14—14 of the clamp of FIG. 13.

FIGS. 13 and 14 show another alternate embodiment of the invention in which cover 1 is provided at the bottom thereof with two integral downwardly depending c-shaped collars 63 and 64 from the two halves 2 and 3 of decorative cover 1. Each collar has outwardly extending, general flat flanges 65 and 66 on each open end thereof, which, when collars 63 and 64 engage post 7 as the halves 2 and 3 are joined to form the decorative cover 1, are brought into parallel opposition to each other. The flanges 65 and 66 are provided with parallel aligned holes 73 and 74 respectively through which threaded bolts 67 and 68 respectively are passed and secured against the flanges 65 and 66 by threading the bolts 67 and 68 onto nuts 69 and 70 respectively. Tightening the bolts 67 and 68 onto nuts 69 and 70 brings the collars 63 and 64 together against post 7 to thereby secure the decorative cover 1 above post 7 and around light 5.

Figure 15:
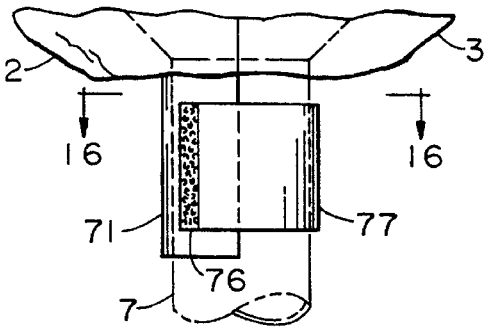
FIG. 15 is a partial side elevation of the base of a decorative cover such as FIG. 1, showing still another embodiment of a base clamping means for mounting a decorative cover to a post.
Figure 16:
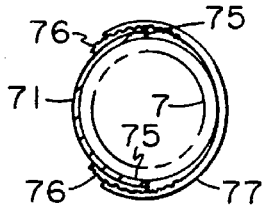
FIG. 16 is a cross-section of the clamping means of FIG. 15, taken on Lines 16—16.

FIGS. 15 and 16 show another alternate embodiment of the instant invention in Which cover 1 is provided on the bottom of half-cover 2 with a downwardly depending collar 71 curved to fit around the post 7. As shown, collar 71 encircles post 7 about half way and at each ends 75 of the collar 71 are provided with Velcro surface 76 affixed to the outer surfaces thereof. On the ends 75 a mating Velcro strip 77 is shown engaged to the Velcro 76 surface and is of sufficient length that it can be wrapped around post 7 to engage and affix itself to the Velcro 76 surface on the opposite end 75 of collar 71 thereby affixing the decorative cover 1 firmly in place above post 7 and around light 5.

Figure 17:
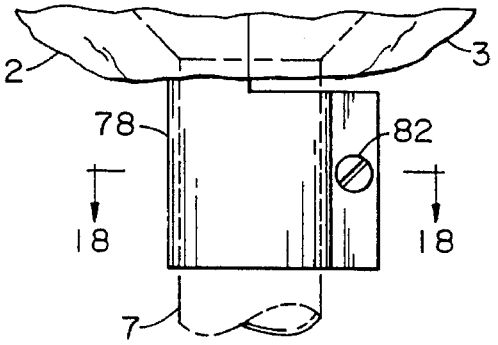
FIG. 17 is a partial side elevation of the base of a decorative cover such as FIG. 1, showing another embodiment of a base clamping means for mounting a decorative cover to a post.
Figure 18:
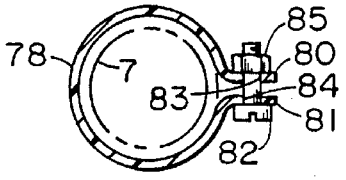
FIG. 18 is a cross-section of the clamping means of FIG. 17 taken on Lines 18—18.

FIGS. 17 and 18 show still a further alternate embodiment of the invention in which decorative cover 1 is provided with a collar 78 extending downwardly from side 2 of cover 1 and which is adapted to encircle the post 7. The collar 78 has two flat flanges 80 and 81, which are positioned opposite to each other with holes 83 and 84 aligned with each other when collar 78 encircles post 7. Bolt 82 passes through holes 83 and 84, and is threaded onto nut 85 to thereby draw the flanges 80 and 81 toward each other to compress collar 78 around post 7 and firmly affix decorative cover 1 above post 7 and around light 5.

Figure 19:
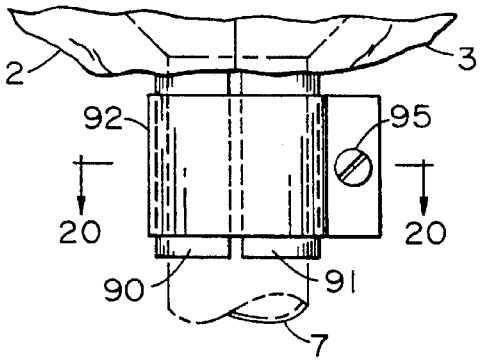
FIG. 19 is a partial side elevation of a decorative cover such as FIG. 1 with another embodiment of a base clamping means for mounting a decorative cover to a post.
Figure 20:
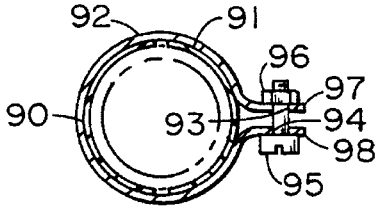
FIG. 20 is a cross-section of the base clamping means of FIG. 19. Taken on Lines 20—20.

In FIGS. 19 and 20 another alternate embodiment of the invention is shown. In this embodiment, the halves 2 and 3 of cover 1 have depending from each of them a support collars 90 and 91. Collars 90 and 91 fit around post 7 when the halves 2 and 3 are brought together around light 5 to form decorative cover 1. In this embodiment, the collars 90 and 91 are tightened around the post 7, using an external band clamp 92 having a threaded bolt 95 and nut 96 passed through the opposed, aligned, holes 93 and 94 in the flat flange ends 97 and 98 of the clamp 92. As the end 97 and 98 are drawn together when the bolt 95 is screwed into the nut 96, the collars 90 and 91 and the decorative cover 1 of which they are an integral part, becomes rigidly fixed to and above the post 7 and around the light 5.

Figure 21:
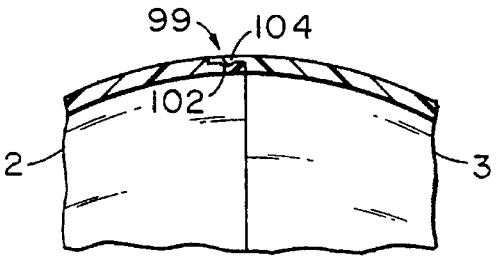
FIG. 21 is a side sectional elevation of the joined sides of a decorative cover showing a tongue and groove configuration utilizing a recessed depression and a boss continuous around the entire circumference.

FIG. 21 shows the jointure of the cover sections 2 and 3 to be a tongue and groove 99 in which groove 102 is a depression and the tongue is a raised boss 104. Both the groove 102 and boss 104 are continuous around the circumference of the sides 2 and 3 and when joined boss 104 snaps into groove 102 to hold the halves together.

Figure 22:
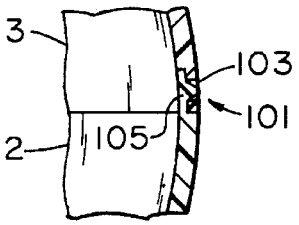
FIG. 22 is a cross-section of the joined sides of a decorative cover showing a slot cut through one half-cover and a boss formed in the mating half-cover provided intermittently around the circumference.

FIG. 22 shows a tongue and groove 101 in which the groove comprises a series of intermittent openings or holes 103 in one cover half and an equal number of raised bosses or nubs 105 to mate with holes 103 and thus maintain sides 2 and 3 of the cover firmly together.

Finally, if desired, as shown in FIGS. 1 and 3, a system for theft prevention can be added to the decorative cover assembly by providing bars 107 an 108 on sleeves 13 and 14. The bars 107 and 108 are provided with contiguous holes 110 when collars 13 and 14 are brought together around post 7. A padlock 109 can then be inserted and locked in place once cover 1 is placed on the post 7.

With respect to the illustrated embodiments described above, it will be evident to the skilled artisan that many modifications may be made to the mounting clamps and collars used to secure the covers to the post without departing from the spirit of the invention. Other clamps or fasteners may be used to perform the same function as the clamps shown. So long as the fastener employed can be secured tight enough around the post holding the light and the cover to ensure that the decorative cover remains above the post it will suffice. These clamps may be separate from the covers as shown in FIG. 3*a* or an integral part of the cover assembly as shown in most of the other illustrative embodiments. The only feature required is that the fastener assembly be capable of forming a secure bond to the light post so that the decorative cover is firmly held in place, and is maintained around the conventionally covered light supported by the post.

In the decorative covers of the instant invention the parts that are used to form the cover in the preferred mode are typically two in number to simplify the number of hinges necessary to complete the cover. While this is preferred, the decorative covers can be made of more than two sections without departing from the scope of the invention. The decorative covers are typically made of plastic material such as polyethylene, polypropylene, vinyls, acrylics, polycarbonates and the like. These materials may be colored to supply appropriate hues for a given holiday or season. So long as the material, when illuminated, glows sufficiently to display the decorative nature of the cover, it will be acceptable. Opaque and translucent covers are what are most desirable since they will display the decoration without highlighting the light source which it covers. Similarly, the cover can be shaped in the form of pumpkins for Halloween, Santa Claus or fir trees for Christmas, snowmen, witches, as flags for July 4th, rabbits for Easter, football helmets for a favorite team, and the like. As long as the decorative cover is capable of being opened so that it can be used to encompass an existing light already having a shade or cover thereon and can then be locked or secured in place around the support for the existing light its material of construction or its decorative shape are not of critical importance.

In the case of FIG. 10, where an opaque or translucent box is used as the invention cover, space is provided on one, more, or all sides for the application of the decorative emblems. These decorations can be applied with suction cups affixed to the back of the decoration, by applying a cover in the shape of the box with the decorations printed or painted thereon, by applying plastic stick-on type pictures, designs and shapes, or by any other convenient means to place a decorative face or design on the surface of the lighted box, as long as its replacement for a change of holiday, season, or the like can be made with ease. A convenient, stick-on plastic design for such a use is made by STICK-EES, Vista, Calif. Color Cling Inc., St. Paul, Minn. also manufactures stick on plastic designs. Dover Publications of Mineola, N.Y. make translucent white papers with many holiday designs that can be placed on the box of FIG. 10. Further, while a box is shown in FIG. 10, other shapes such as globes, cones and the like can be used in lieu of a box.

In clamping the decorative cover to the post or support for the conventional light source, gaskets of various kinds can be employed to enhance the bond between the clamp and the sleeve and assist in providing some measure of protection to the sleeve material which may in some instances be relatively thin plastic or cloth. These gaskets can be made of natural or synthetic rubber, felt, compositions such as micarta and the like.

The sections used to make up the decorative covers of the instant invention should be constructed so that as joined they fit with ease around the covered mounted light fixture they are to enclose. Thus the width of the decorative covers are generally in excess of 6 inches in diameter. Most inground walkway lights with the covers on are typically 5 inches or more in diameter at the widest point of the shades used and it is preferable to provide decorative covers that encompass the shade with enough clearance all around to have them stand over the light without disturbing or touching the existing shade and/or covers. With lampposts or carriage lights of course, the decorative covers will tend to be much longer and wider to accommodate the height and width of these light fixtures. In similar fashion, the decorative covers of the instant invention are provided with sufficient height and width to cover the existing shade and/or cover of the mounted light it encloses without encroaching upon it or touching it.

Finally, it should be noted that the embodiments of FIGS. 1 through 19 which provide for collars and sleeves and clamps which encompass mounting posts are shown to be integral parts of the cover parts. The same sleeves and clamping means shown in these figures can be applied to the covers mechanically as shown in FIG. 3*a* as separate parts. While FIG. 3*a* illustrates doing this with a sleeve and clamp system like that of FIG. 1, it can be done with other sleeves and clamps of the invention using the same principle of attaching sleeves and collars to the covers mechanically with flanged mounts.

These, and other modifications to the invention may be made without departing from the spirit and scope of the invention. Thus, while reference has been made herein to certain illustrative embodiments, it is not intended that the invention be limited thereby except insofar as is appears in the accompanying claims.

I claim:

1. A decorative cover for enclosing a covered light mounted on a post comprising at least two sections forming the decorative cover, said sections being joined together in a hinged relationship to permit the sections to mate forming the decorative cover and to open sufficiently away from each other to permit removal from the covered light, means at the bottom of at least one of said sections and extending downwardly therefrom constructed and arranged to engage the covered light post and form a mounting sleeve thereon when the sections mate to form the decorative cover and means to clamp said sleeve to the post to maintain the decorative cover above the post and enclosing the covered light.

2. The decorative cover of claim 1 wherein the means forming the sleeve and the clamping means are integral parts of the decorative cover sections.

3. The decorative cover of claim 1 wherein the means forming the sleeve is integral with the decorative cover sections and the clamping means are separate and distinct from the cover sections.

4. The decorative cover of claim 1 wherein the means forming the sleeve and the clamping means are separate and distinct from the sections of the decorative cover and means are provided to attach the sleeve forming means and clamping means to the sections forming the decorative cover.

5. The decorative cover of claim 1 wherein the sleeve forming means comprises two c-shaped collars for engaging the light post, contiguous slots on the outer surface of each collar, the slots provided with swing eye bolts therein, and means to tighten the bolts against the collars to secure the decorative cover to the post.

6. The decorative cover of claim 1 where in the mating surface of said sections are arranged in a tongue and groove configuration for engagement when said sections are closed around the mounted covered light to form said decorative cover.

7. The decorative cover of claim 1 wherein the sections of said decorative cover are fastened together with clips after they are placed around the covered light.

8. The decorative cover of claim 6 wherein the sections forming the cover have fasteners applied to hold them together when they are closed to form the decorative cover around the mounted covered light.

9. The decorative cover of claim 1 wherein the hinge means is a flexible plate fastened to each of said sections and creased to permit the sections to flex sufficiently to enable them to be placed over said mounted covered light.

10. The decorative cover of claim 1 wherein the said sections are joined together at the top of each section by a hinge attached thereto, said hinge permitting said sections to open sufficiently to enable them to encompass said mounted covered light.

11. The decorative cover of claim 1 wherein the sections and means forming the mounting sleeve are constructed of plastic.

12. The decorative cover of claim 11 wherein the plastic used is translucent or opaque to the covered light the decorative cover encompasses.

13. The decorative cover of claim 1 wherein the shape of the decorative cover formed by said sections is a cube, said cube having plain opaque or translucent sides on which are displayed removable decorative designs.

14. The decorative cover of claim 1 wherein said means forming the mounting sleeve comprises a downwardly depending u-shaped collar for engaging said post having flanges on each end thereof, one of said flanges being tapped on the end with a threaded hole, the opposing flange being provided with a hole for insertion of a bolt therethrough to permit a bolt to engage the opposing flange and bring the sides of the collar around the post of the covered light.

15. The decorative cover of claim 1 wherein said means forming the sleeve comprise two downwardly depending c-shaped collars for engaging said post, each of said collars having flat flanges extending outwardly therefrom and having aligned holes therein when placed around said post to thereby accommodate a bolt passing through them which can be tightened to draw the 2 c-shaped collars firmly around said post.

16. The decorative cover of claim 1 wherein the downwardly depending means forming the sleeve comprises a collar means on one of said sections contoured to engage at least one-half the circumference of said post on its interior surface, the external surface of said collar having a Velcro covering applied thereto and a mating Velcro surface being attached to one side of the Velcro covering and extending outwardly therefrom for a sufficient distance so that it can be placed around said post and attached to the Velcro covering on the opposite side.

17. The decorative cover of claim 1 wherein the downwardly depending means forming the sleeve comprise at least two collars contoured to engage said post, with an external clamp placed around said collars and means to tighten the clamp around the collars are provided on said clamp.

18. A decorative cover for enclosing a covered light mounted to a post comprising a shaped decorative cover having two joined sections, each of said sections forming the shaped decorative cover being attached at their tops by a hinge, said hinge permitting the attached sections to move toward each other to close and form said shaped decorative cover or away from each other to permit said shaped decorative cover to be removed from any mounted covered light it encloses, means depending downwardly from each of said two sections forming collars which engage said post, and means to firmly attach said collars around said post to maintain the shaped decorative cover around the mounted light and above the post.

19. The decorative cover of claim 18 wherein the collars and two sections are integral with each other.

20. The decorative cover of claim 1 wherein the decorative cover assembled around the covered light is comprised of opaque surfaces capable of having attached thereto removable decorative designs.

21. The decorative cover of claim 1 wherein the decorative cover assembled around the covered light is comprised of translucent surfaces capable of having attached thereto removable decorative designs.

* * * * *